US009708963B2

(12) United States Patent
Hayama et al.

(10) Patent No.: US 9,708,963 B2
(45) Date of Patent: Jul. 18, 2017

(54) EXHAUST DEVICE OF MOTORCYCLE

(71) Applicant: HONDA MOTOR CO., LTD., Tokyo (JP)

(72) Inventors: Yoshitaka Hayama, Wako (JP); Yoshitaka Seki, Wako (JP); Hiromi Shibata, Wako (JP); Takeru Abe, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/051,644

(22) Filed: Feb. 23, 2016

(65) Prior Publication Data

US 2016/0245147 A1 Aug. 25, 2016

(30) Foreign Application Priority Data

Feb. 25, 2015 (JP) ..... 2015-035093

(51) Int. Cl.

| | |
|---|---|
| ***F01N 3/00*** | (2006.01) |
| ***F02B 75/00*** | (2006.01) |
| ***F02B 75/18*** | (2006.01) |
| ***F01N 13/10*** | (2010.01) |
| ***F01N 13/00*** | (2010.01) |
| ***F01N 1/00*** | (2006.01) |

(52) U.S. Cl.

CPC ..... *F01N 13/107* (2013.01); *F01N 1/00* (2013.01); *F01N 13/008* (2013.01); *F01N 13/011* (2014.06); *F01N 13/10* (2013.01); *F01N 2260/00* (2013.01); *F01N 2340/00* (2013.01); *F01N 2340/04* (2013.01); *F01N 2470/20* (2013.01); *F01N 2560/025* (2013.01); *F01N 2560/06* (2013.01); *F01N 2590/04* (2013.01)

(58) Field of Classification Search

CPC .... F01N 13/107; F01N 13/011; F01N 13/008; F01N 11/002; F01N 11/007; F01N 2550/02

USPC ..... 60/272–324

See application file for complete search history.

(56) References Cited

U.S. PATENT DOCUMENTS 4,475,512 A * 10/1984 Suzuki ..... F02D 41/1474 123/694

5,271,477 A * 12/1993 Gekka ..... F01N 3/28 180/219

(Continued)

FOREIGN PATENT DOCUMENTS

JP 60022017 A * 2/1985

JP 06200741 A * 7/1994

(Continued)

*Primary Examiner* — Mark Laurenzi

*Assistant Examiner* — Anthony Ayala Delgado

(74) *Attorney, Agent, or Firm* — Chip Law Group

(57) ABSTRACT

An exhaust device includes left and right exhaust pipes and mufflers connected to a downstream side of the left and right exhaust pipes. The pair of left and right exhaust pipes respectively includes a merging portion. A catalyst is provided to the merging portion respectively. The pair of left and right exhaust pipes respectively includes, on a downstream side of the catalyst, a branching portion that has one side thereof extending to the muffler and the other side thereof extending to a connecting pipe. An oxygen sensor is provided to one side on a downstream side of the pair of left and right branching portions.

4 Claims, 7 Drawing Sheets

(56) References Cited

U.S. PATENT DOCUMENTS

| | | | | | |
|---|---|---|---|---|---|
| 5,325,664 | A * | 7/1994 | Seki | F01N 11/002 | 60/276 |
| 5,360,081 | A * | 11/1994 | Takegami | F01N 3/28 | 180/219 |
| 6,082,103 | A * | 7/2000 | Sugiura | F01N 13/008 | 60/272 |
| 6,182,446 | B1 * | 2/2001 | Gunther | F01N 3/20 | 60/278 |
| 7,458,210 | B2 * | 12/2008 | Kikuchi | F01N 13/08 | 60/313 |
| 7,856,815 | B2 * | 12/2010 | Demura | F01N 3/2006 | 60/285 |

FOREIGN PATENT DOCUMENTS

| | | | | |
|---|---|---|---|---|
| JP | 2003-314383 | A | 11/2003 | |
| JP | EP 1900624 | A1 * | 3/2008 | B62K 11/04 |

* cited by examiner

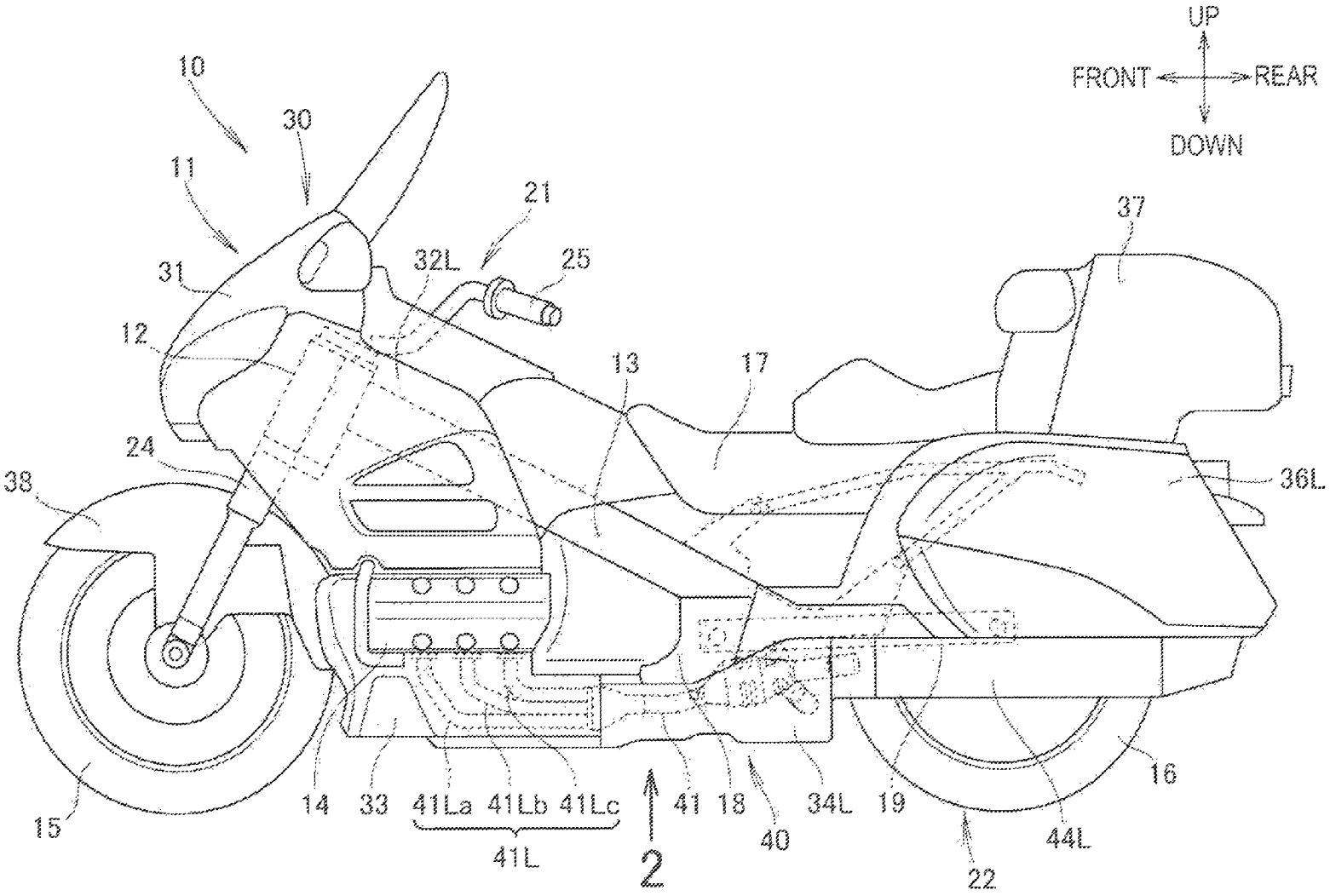
[FIG. 1]

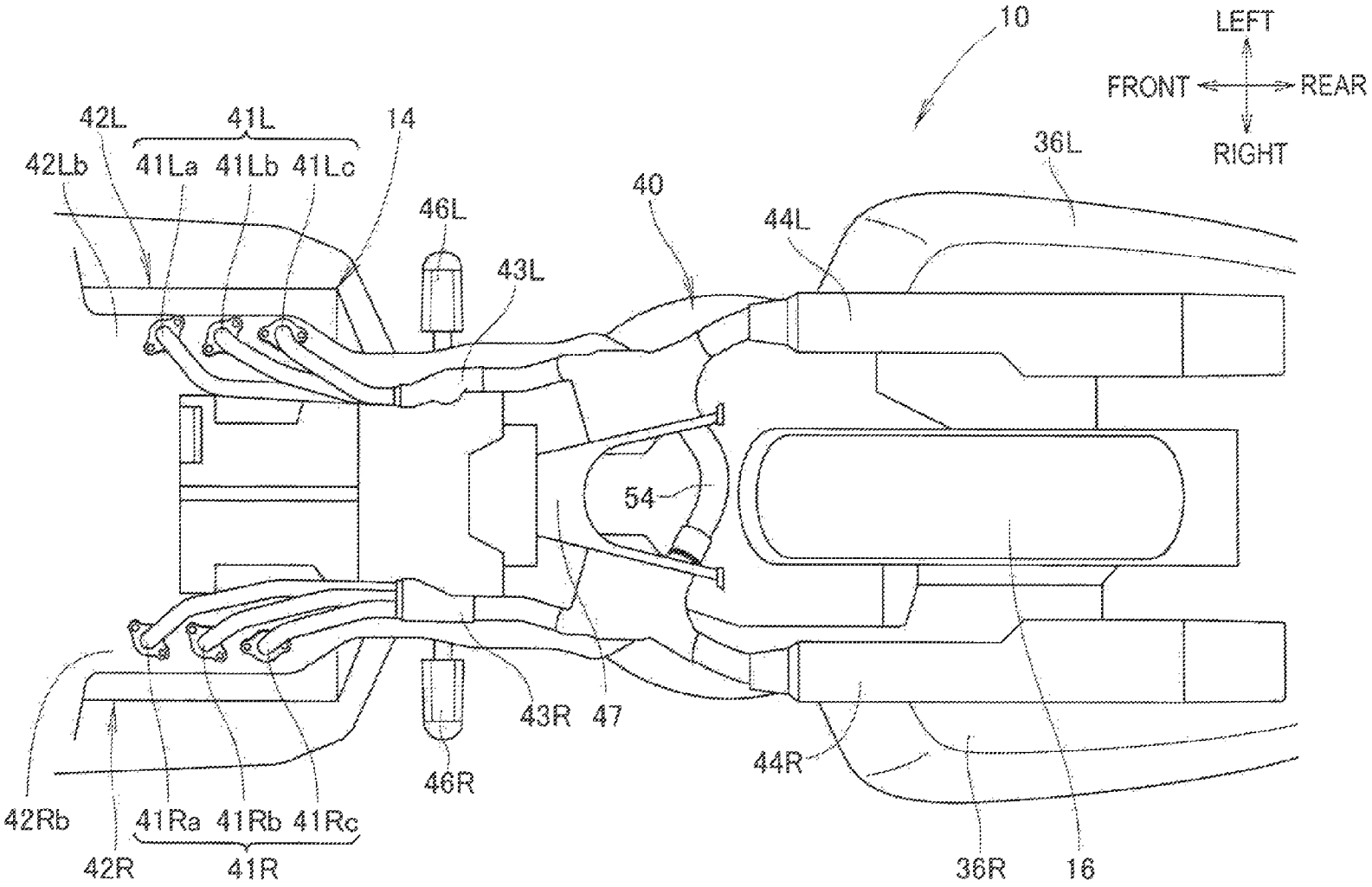
[FIG. 2]

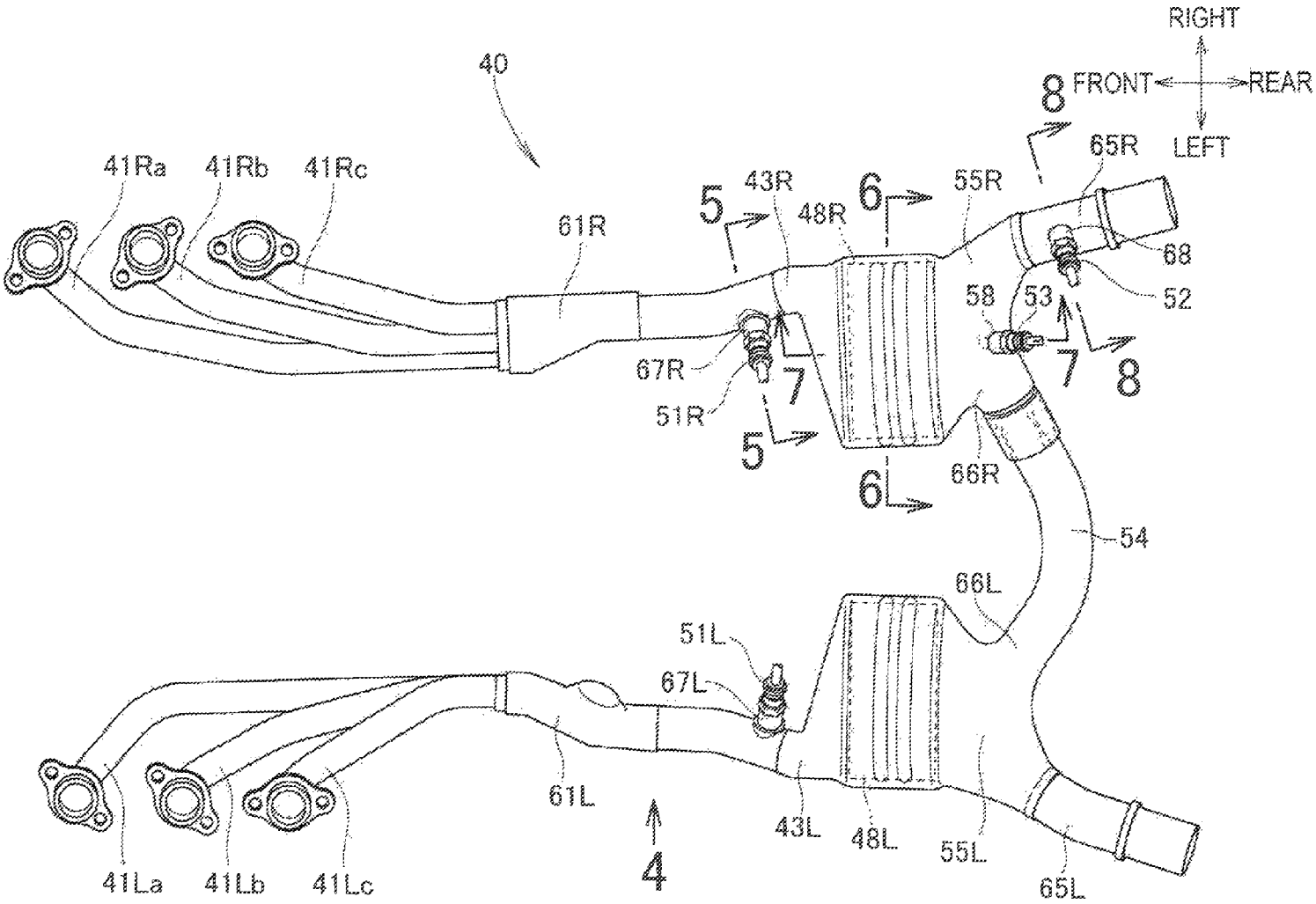
[FIG. 3]

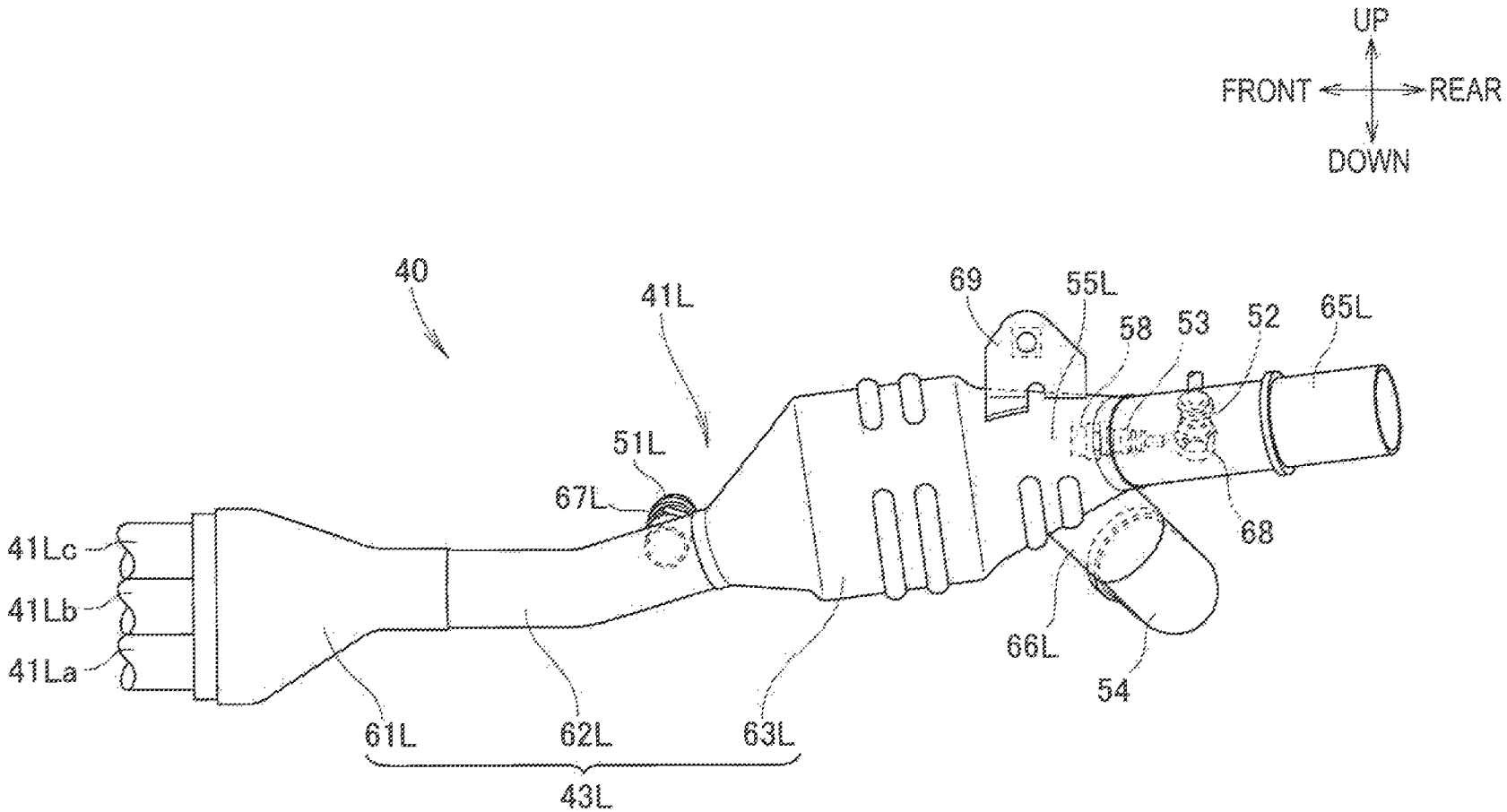
[FIG. 4]

[FIG. 5]
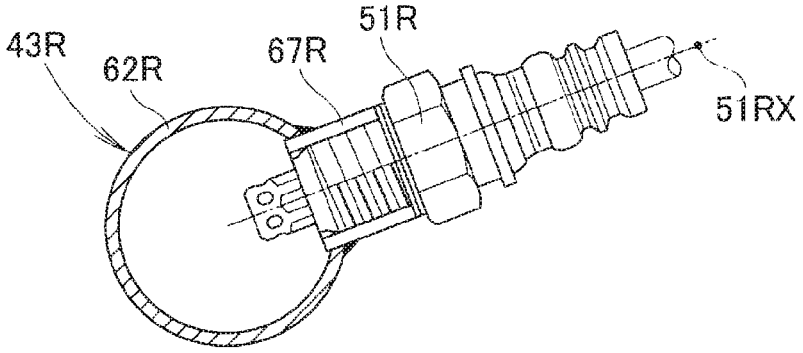
[FIG. 6]
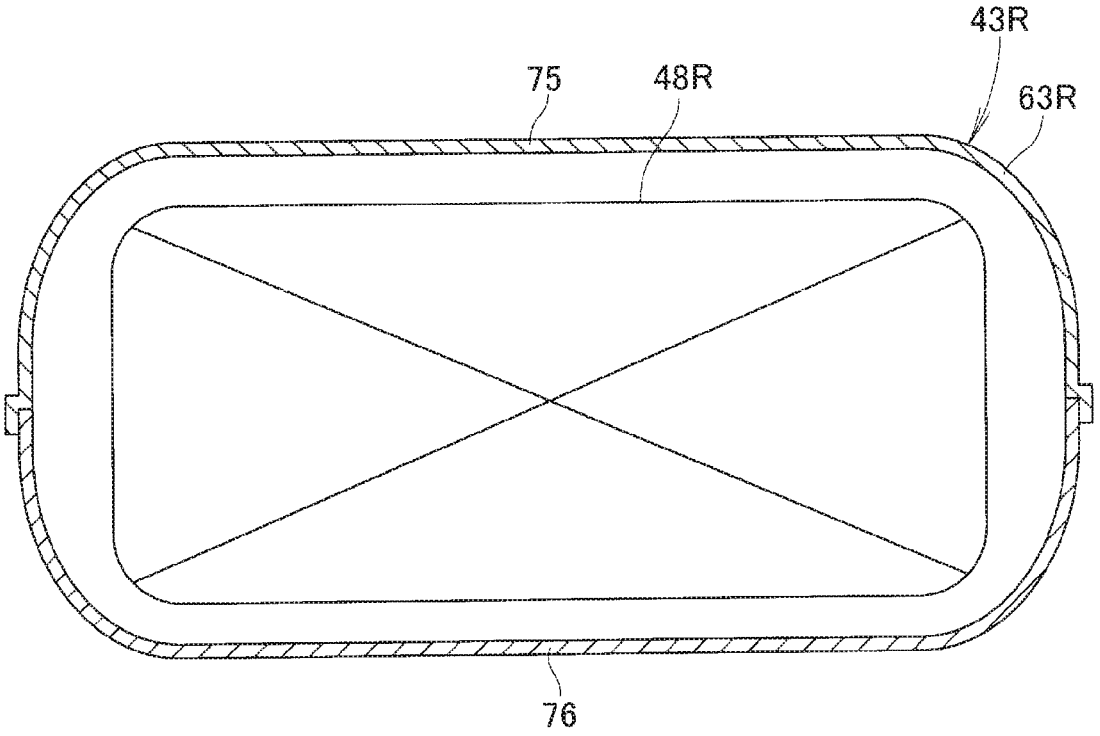

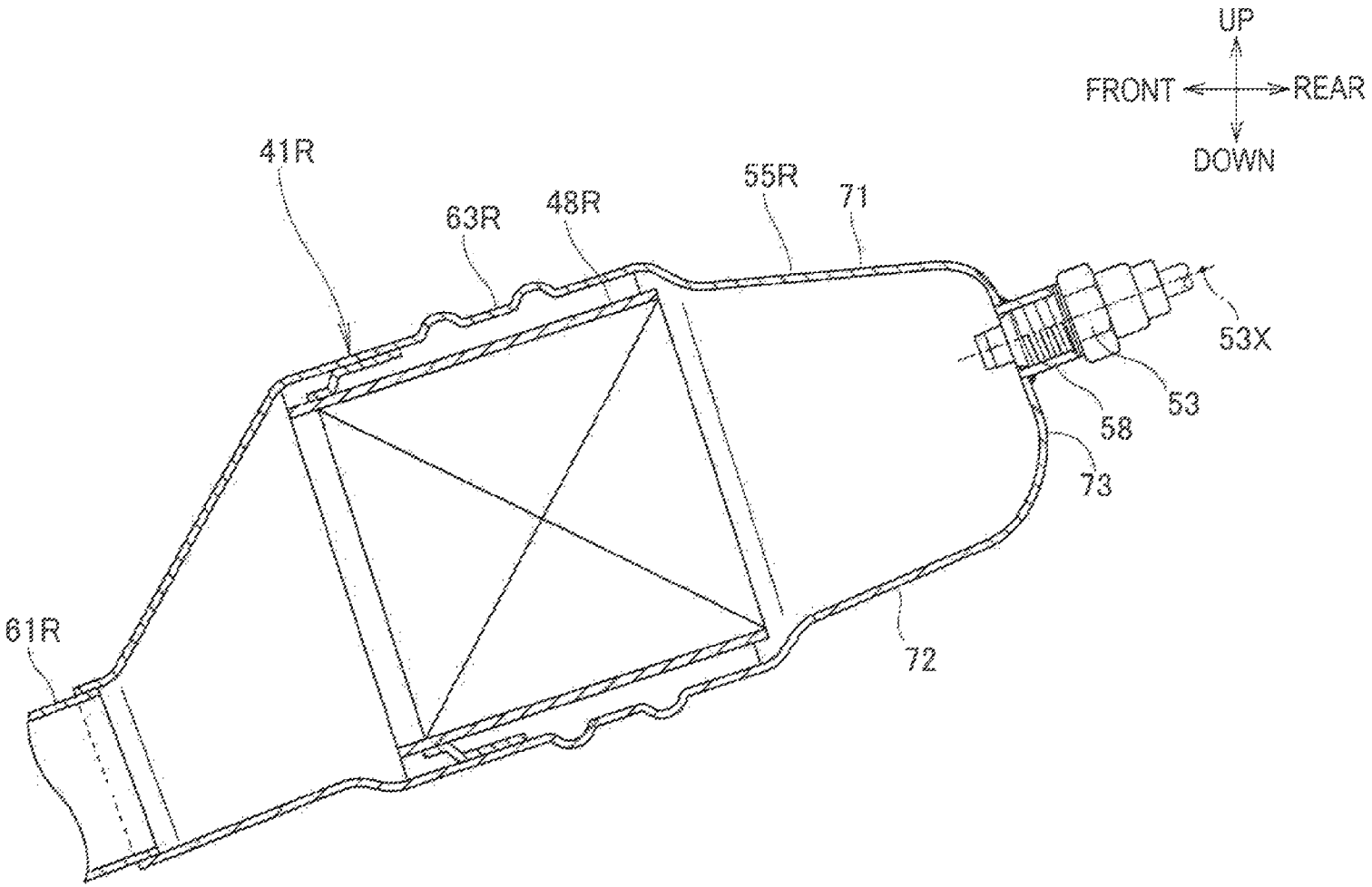
[FIG. 7]

[FIG. 8]
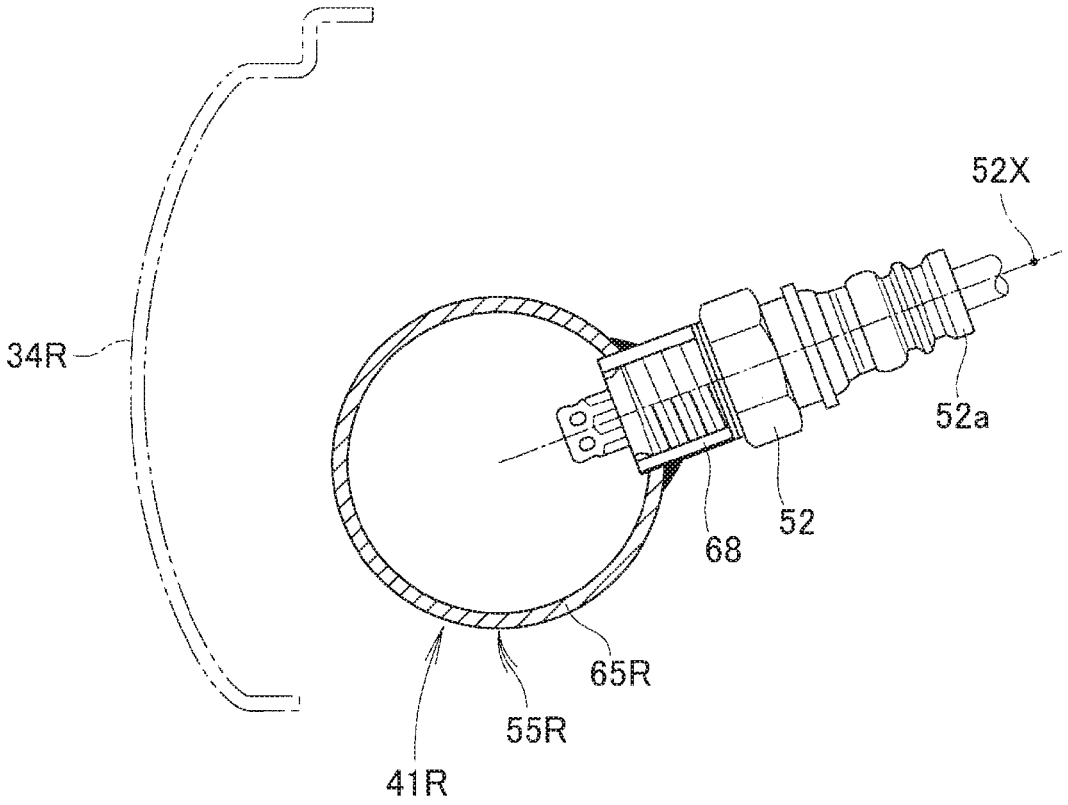

EXHAUST DEVICE OF MOTORCYCLE

CROSS REFERENCE TO RELATED APPLICATIONS

This application claims the benefit of Japanese Priority Patent Application JP 2015-035093 filed on Feb. 25, 2015, the entire contents of which are incorporated herein by reference.

TECHNICAL FIELD

The present application relates to an improvement of an exhaust device of a motorcycle equipped with an oxygen sensor.

BACKGROUND ART

Conventionally, there has been known an exhaust device of an internal combustion engine equipped with an oxygen sensor (see Patent Literature 1 (FIG. 1), for example).

As shown in FIG. 1 of Patent Literature 1, an exhaust passage (7) extends from an internal combustion engine (1) (numeral with a parenthesis indicating a symbol described in Patent Literature 1, the same indication applied hereinafter), a catalyst (8) which purifies an exhaust gas is provided to a middle portion of the exhaust passage (7), an oxygen sensor (27a) is arranged on an upstream side of the catalyst (8), and another oxygen sensor (27b) is arranged on a downstream side of the catalyst (8).

In an internal combustion engine (engine) having a plurality of cylinders, an exhaust gas discharged from the respective cylinders flows through exhaust pipes and, thereafter, are merged together by a merging pipe connected to a downstream side of these exhaust pipes. In this case, when the exhaust pipes extend linearly from the respective cylinders, there is a possibility that an exhaust gas discharged from the respective cylinders is not sufficiently stirred in the inside of the merging pipe. Eventually, data obtained by an oxygen sensor which is arranged in the inside of the merging pipe and detects oxygen in an exhaust gas is likely to become data for a local area in the merging pipe.

On the other hand, when a catalyst and an exhaust gas chemically react with each other, the difference in chemical reaction speed arises depending on portions of the catalyst. Accordingly, when an oxygen sensor is arranged on a downstream side of the catalyst, unless an exhaust gas which reacts with a catalyst is sufficiently stirred, data obtained by the oxygen sensor is likely to become data for a local area in the merging pipe. Accordingly, in the case where an oxygen sensor is provided upstream and downstream of a catalyst, it is desirable to homogenize an exhaust gas by sufficiently stirring the exhaust gas.

In mounting an exhaust device on a motorcycle, there may by a case where an engine of the motorcycle is exposed to the outside of the motorcycle. In a vehicle where an engine is exposed to the outside of the vehicle, there may be a case where the exhaust device is exposed to a natural environment such as rain and a traveling wind. When the catalyst is exposed to rain or a traveling wind, the exhaust device is likely to be cooled and hence, there is a possibility that purification performance of the catalyst is lowered. Accordingly, when a temperature around the catalyst is unknown, it is necessary to use a catalyst having a volume slightly larger than usual by taking into account an amount of lowering of purification performance of the catalyst caused by an external environment. Eventually, the catalyst becomes enlarged.

There has been a demand for an exhaust device of a motorcycle which can detect oxygen in an exhaust gas in a state where the exhaust gas is sufficiently stirred, and also can realize the miniaturization of a catalyst.

PRIOR ART LITERATURE

Patent Literature

[Patent Literature 1] JP-A-2003-314383

SUMMARY OF THE APPLICATION

It is an object of the application to provide an exhaust device of a motorcycle which can detect oxygen in an exhaust gas in a state where the exhaust gas is sufficiently stirred, and also can realize the miniaturization of a catalyst.

The embodiments described in claim 1 are directed to an exhaust device of a motorcycle comprising: a pair of left and right exhaust pipes for discharging an exhaust gas from a multi-cylinder engine; and a muffler connected to a downstream side of the exhaust pipe, the muffler being provided for reducing an exhaust noise and for discharging an exhaust gas to the outside, wherein the pair of left and right exhaust pipes includes a merging portion for merging respective cylinders respectively, and a catalyst for purifying an exhaust gas is provided to the merging portion respectively, and the pair of left and right exhaust pipes includes, on a downstream side of the catalyst, a branching portion which has one side thereof extending to the muffler and the other side thereof extending to a connecting pipe which connects the pair of left and right exhaust pipes to each other, and an oxygen sensor is provided to said one side on a downstream side of the pair of left and right branching portions, whereby an exhaust gas is stirred in a rear portion of the merging portion and the branching portion.

The embodiments described in claim 2 are characterized in that a temperature sensor is provided to the branching portion on a downstream side of the oxygen sensor.

The embodiments described in claim 3 are characterized in that an upper end of the oxygen sensor is directed toward the inside in a vehicle width direction, and overlaps with left and right protectors which cover the pair of left and right exhaust pipes as viewed in a side view of the vehicle.

The embodiments described in claim 4 are characterized in that the connecting pipe is arranged below the oxygen sensor and is arranged so as to overlap with the oxygen sensor in a longitudinal direction of the vehicle.

According to the embodiments described in claim 1, the oxygen sensor is provided on one side at a downstream side of the branching portion included in the pair of left and right exhaust pipes on a downstream side of the catalyst. An exhaust gas passes through the catalyst disposed in the merging portion of the exhaust pipes, and reaches the pair of left and right branching portions. At this stage of operation, the exhaust gas is expanded and stirred in the rear portion of the merging portion and the left and right branching portions. The exhaust gas sufficiently stirred in the left and right branching portions comes into contact with the oxygen sensor provided to one side at the downstream side of the branching portion. Accordingly, a state of the catalyst can be more accurately determined.

According to the embodiments described in claim 2, the temperature sensor is provided to the branching portion on a downstream side of the oxygen sensor. The temperature sensor is arranged at a position closer to the catalyst than the oxygen sensor is and hence, a reaction heat generated by a chemical reaction of the catalyst can be detected more accurately. The degree of activation of the catalyst and a state of the catalyst can be more accurately determined not only by the oxygen sensor but also by the temperature sensor. Since an activation state of the catalyst can be grasped more accurately, the miniaturization of the catalyst can be realized.

According to the embodiments described in claim 3, the upper end of the oxygen sensor is directed inward in a vehicle width direction, and overlaps with left and right protectors which cover the pair of left and right exhaust pipes. That is, the oxygen sensor is arranged at the position where the oxygen sensor is not exposed to the outside in the vehicle width direction and hence, it is possible to provide the structure which is minimally cooled by an external environment such as rain or a traveling wind. As a result, a state of the catalyst can be determined more accurately.

According to the embodiments described in claim 4, the connecting pipe is arranged below the oxygen sensor and is arranged so as to overlap with the oxygen sensor in a longitudinal direction of the vehicle. A traveling wind which flows below the vehicle, muddy water splashed by a front wheel or the like hits the connecting pipe arranged below the oxygen sensor and hence, a traveling wind, muddy water or the like minimally hits the oxygen sensor. Accordingly, the oxygen sensor has the structure where the oxygen sensor is minimally cooled by an external environment such as a traveling wind or muddy water. Eventually, the oxygen sensor can determine a state of the catalyst more accurately.

BRIEF DESCRIPTION OF THE DRAWINGS

FIG. 1 is a left side view of a motorcycle according to the embodiments of the application.

FIG. 2 is a view for explaining an exhaust device as viewed in the direction indicated by an arrow 2 in FIG. 1

FIG. 3 is a plan view of the exhaust device provided to the motorcycle according to the embodiments of the application.

FIG. 4 is a left side view of the exhaust device as viewed in the direction indicated by an arrow 4 in FIG. 3.

FIG. 5 is a cross-sectional view taken along a line 5-5 in FIG. 3.

FIG. 6 is a cross-sectional view taken along a line 6-6 in FIG. 3.

FIG. 7 is a cross-sectional view taken along a line 7-7 in FIG. 3.

FIG. 8 is a cross-sectional view taken along a line 8-8 in FIG. 3.

DETAILED DESCRIPTION

Hereinafter, an embodiment of the invention is explained in detail. In the drawings and the embodiment, the directions of "up", "down", "front", "rear", "left", and "right" indicate directions as viewed from a rider who rides on a motorcycle respectively.

The embodiments of the application are explained with reference to drawings.

As shown in FIG. 1, a motorcycle 10 is a saddle-ride-type vehicle where a main frame 13 which extends from a head pipe 12 toward a rear side of the vehicle, and a pivot frame 18 which extends downward from the main frame 13 are mounted on a vehicle body frame 11. A multi-cylinder engine 14 is suspended from the vehicle body frame 11. A front wheel steering portion 21 including a front wheel 15 is mounted on the head pipe 12 in a steerable manner. A rear wheel suspension portion 22 is supported on the pivot frame 18 in a swingable manner. A seat 17 is mounted on the vehicle body frame 11 between the front wheel 15 and the rear wheel 16, and an occupant rides on the vehicle in a state where the rider straddles the seat 17.

The front wheel steering portion 21 which is mounted on the vehicle body frame 11 in a steerable manner includes, as main constitutional elements thereof: a front fork 24 which is mounted on the head pipe 12 in a rotatable manner; the front wheel 15 which is supported on a lower end of the front fork 24; and a steering handle 25 which is mounted on an upper end of the front fork 24. The rear wheel suspension portion 22 includes: a swing arm 19 which extends toward the rear side of the vehicle from the pivot frame 18, and the rear wheel 16 which is supported on a rear end portion of the swing arm 19.

The vehicle body cover 30 which covers a vehicle body includes: a front cowl 31; left and right front side cowls 32L, 32R (only the front side cowl 32L on a viewer's side in the drawing is shown) which extend toward the rear side of the vehicle from the front cowl 31 up to an upper side of the engine 14; an under cowl 33 which covers the engine 14 from below and an exhaust device 40, and left and right protectors 34L, 34R (only the left protector 34L on a viewer's side in the drawing is shown) which are disposed continuously with a rear side of the under cowl 33 and cover the exhaust device 40.

Left and right trunks 36L, 36R for storing articles are disposed on lateral sides of the rear wheel 16 on a rear portion of the vehicle, and a rear trunk 37 is arranged above the left and right trunks 36L, 36R. A front fender 38 for preventing sticking of mud splashed by the front wheel 15 is mounted on the front fork 24.

As shown in FIG. 2, the engine 14 mounted on the motorcycle 10 is a horizontally opposed 6-cylinder engine. The exhaust device 40 is provided to the multi-cylinder engine (engine having a plurality of cylinders). In a bottom plan view of the vehicle as viewed from below, cylinder portions 42L, 42R of the engine 14 are disposed on left and right sides in the vehicle width direction. Exhaust pipes 41La, 41Lb, 41Lc, 41Ra, 41Rb, 41Rc for discharging an exhaust gas extend from lower surfaces 42Lb, 42Rb of the cylinder portions 42L, 42R, respectively.

Left and right merging portions 43L, 43R are connected to downstream sides of the pair of left and right exhaust pipes 41L (41La, 41Lb, 41Lc), 41R (41Ra, 41Rb, 41Rc), respectively, and mufflers 44L, 44R for reducing exhaust noises and for discharging an exhaust gas to the outside are connected to downstream sides of the left and right merging portions 43L, 43R, respectively.

Foot rests 46L, 46R on which an occupant places his feet are mounted on the pivot frame 18, and a main stand 47 is mounted on the pivot frame 18.

As shown in FIG. 3, the pair of left and right exhaust pipes 41L, 41R extends toward the rear side of the vehicle. The pair of left and right exhaust pipes 41L, 41R respectively includes the left and right merging portions 43L, 43R where the respective cylinders are merged together. A catalyst 48L, 48R for purifying an exhaust gas is disposed in the left and right merging portions 43L, 43R, respectively. An upstream-side oxygen sensor 51L, 51R is provided to the pair of left and right exhaust pipes 41L, 41R on an upstream side of the catalysts 48L, 48R, respectively.

On the downstream side of the catalysts 48L, 48R, the pair of left and right exhaust pipes 41L, 41R respectively includes a branching portion 55L, 55R which has one side thereof extending to the mufflers 44L, 44R (see FIG. 2) and the other end thereof extending to a connecting pipe 54 which connects the pair of left and right exhaust pipes 41L, 41R to each other. A downstream-side oxygen sensor 52 is provided to one side (the rear side of the vehicle) on a downstream side of the right branching portion 55R out of the pair of left and right branching portions 55L, 55R. As described later, rear portions of the left and right merging portions 43L, 43R and the left and right branching portions 55L, 55R are configured to have a larger cross-sectional area in cross section perpendicular to the longitudinal direction of the exhaust pipe than other portions of the exhaust pipe. With such a configuration, an exhaust gas is expanded and is stirred in the rear portions of the left and right merging portions 43L, 43R and the left and right branching portions 55L, 55R. A temperature sensor 53 is further provided to the branching portion 55R on a downstream side of the downstream-side oxygen sensor 52. Hereinafter, the downstream-side oxygen sensor 52 is simply referred to as an oxygen sensor 52.

As shown in FIG. 4, the left merging portion 43L is provided to a downstream end of the left exhaust pipe 41L. The left merging portion 43L includes: a first merging portion 61L to which three exhaust pipes 41La, 41Lb, 41Lc are merged together and whose diameter is decreased so as to decrease a cross-sectional area of the left exhaust pipe 41L; a left second merging portion 62L which is connected to a downstream end of the first merging portion 61L, has a constant cross-sectional area and extends toward the rear side of the vehicle; a third merging portion 63L which is connected to a downstream end of the left second merging portion 62L, has a diameter thereof enlarged so as to increase a cross-sectional area of the left exhaust pipe 41L and eventually has a cross-sectional area larger than respective cross-sectional areas of the first merging portion 61L and the left second merging portion 62L, and accommodates the catalyst 48L (see FIG. 2) therein; and the branching portion 55L which is formed contiguously with the left merging portion 43L.

A one-side extending portion 65L which extends toward the rear side of the vehicle and an other-side extending portion 66L which extends inward in the vehicle width direction are provided to a downstream side of the branching portion 55L, respectively. The connecting pipe 54 is connected to the other-side extending portion 66L. Returning to FIG. 3, the other-side extending portion 66L and the connecting pipe 54 are formed integrally with each other. In this embodiment, although the other-side extending portion and the connecting pipe are formed integrally with each other, the other-side extending portion and the connecting pipe may be formed separately from each other without any problems.

The connecting pipe 54 is arranged such that the connecting pipe 54 is disposed below the oxygen sensor 52 and overlaps with the oxygen sensor 52 in the longitudinal direction of the vehicle. An exhaust pipe stay 69 provided for mounting the left exhaust pipe 41L on the vehicle body frame extends upward from the third merging portion 63L.

The right branching portion is arranged in symmetry with the left branching potion with respect to a center line in the vehicle width direction and hence, the explanation of the structure of the right branching portion is omitted.

Returning to FIG. 3, the oxygen sensor 52 is provided to the right one-side extending portion 65R.

As shown in FIG. 5, an upstream-side boss 67R is mounted on the right second merging portion 62R which forms the right merging portion 43R, and the upstream-side oxygen sensor 51R is mounted on the upstream-side boss 67R. The upstream-side oxygen sensor 51R is arranged in an inclined manner with respect to the horizontal direction such that an axis 51RX of the upstream-side oxygen sensor is directed inward in the vehicle width direction.

The right second merging portion 62R including the upstream-side oxygen sensor is arranged in symmetry with the left second merging portion with respect to the center line in the vehicle width direction and hence, the explanation of the structure of the right second merging portion is omitted.

As shown in FIG. 6, the third merging portion 63R which forms the merging portion is formed by making an upper half body 75 and a lower half body 76 respectively having a semi-elliptical shape vertically about each other. The catalyst 48R for purifying an exhaust gas is accommodated in the third merging portion 63.

The left third merging portion is arranged in symmetry with the right third merging portion with respect to the center line in the vehicle width direction and hence, the explanation of the structure of the left third merging portion is omitted.

As shown in FIG. 7, the branching portion 55R which extends contiguously from the third merging portion 63R includes: a ceiling wall 71 which is provided to a downstream side of the catalyst 48R; a bottom wall 72 which is arranged to face the ceiling wall 71 in an opposed manner; and a rear wall 73 which extends between the ceiling wall 71 and the bottom wall 72 and faces the rear side of the vehicle.

A temperature sensor boss 58 is mounted on the rear wall 73, and the temperature sensor 53 is mounted on the temperature sensor boss 58. A longitudinal axis 53X of the temperature sensor 53 extends so as to be directed toward the rear side of the vehicle.

The left branching portion and the right branching portion are arranged symmetry with respect to the center line in the vehicle width direction and hence, the explanation of the structure of the left branching portion is omitted.

As shown in FIG. 8, an oxygen sensor boss 68 is mounted on the one-side extending portion 65R which forms the branching portion 55R, and the oxygen sensor 52 is mounted on the oxygen sensor boss 68. A longitudinal axis 52X of the oxygen sensor 52 extends so as to be directed toward the inside of the vehicle. That is, an upper end 52*a* of the oxygen sensor 52 is directed inward in the vehicle width direction.

The right protector 34R which covers the exhaust pipe 41 is arranged outside the one-side extending portion 65R of the exhaust pipe 41 in the vehicle width direction. That is, the right protector 34R covers the right exhaust pipe 41R as viewed in a side view of the vehicle.

Although the left protector 34L (see FIG. 1) which covers the exhaust pipe 41 is arranged on a left side in the vehicle width direction, the left protector 34L and the right protector have the laterally symmetrical structure with respect to the center line in the vehicle width direction and hence, the explanation of the structure of the left protector 34L is omitted.

Next, the manner of operation of the above-mentioned exhaust device of the motorcycle is described.

Referring also to FIG. 3, FIG. 7 and FIG. 8, on a downstream side of the catalysts 48L, 48R and on a downstream side of the left and right branching portions 55L, 55R of the pair of left and right exhaust pipes 41L, 41R, the oxygen sensor 52 is provided to one side (the rear side in the longitudinal direction of the vehicle) of the right exhaust pipe 41R.

An exhaust gas passes through the catalysts 48L and 48R disposed in the left and right merging portions 43L, 43R of the exhaust pipe 41, and reaches the pair of left and right branching portions 55L, 55R. At this stage of operation, the exhaust gas is expanded and stirred in the rear portions of the left and right merging portions 43L, 43R and the left and right branching portions 55L, 55R. The exhaust gas stirred in the left and right branching portions 55L, 55R is brought into contact with the oxygen sensor 52 provided to one side (the rear side in the longitudinal direction of the vehicle) of the right exhaust pipe 41R on the downstream side of the left and right branching portions 55L, 55R. Accordingly, a state of the catalyst 48R can be determined more accurately.

The temperature sensor 53 is provided to the right branching portion 55R on a downstream side of the oxygen sensor 52. The temperature sensor 53 is arranged at a position closer to the catalyst 48R than the oxygen sensor 52 is and hence, a reaction heat generated by a chemical reaction of the catalyst 48R can be detected more accurately. The degree of activation of the catalyst 48R and a state of the catalyst 48R can be further accurately determined not only by the oxygen sensor 52 but also by the temperature sensor 53. Since an activation state of the catalyst 48R can be grasped more accurately, the miniaturization of the catalyst 48R can be realized.

In this embodiment, the oxygen sensor and the temperature sensor are provided to the downstream side of the right exhaust pipe, and neither the oxygen sensor nor the temperature sensor are provided to the downstream side of the left exhaust pipe. However, the oxygen sensor and the temperature sensor may be provided only to the downstream side of the left exhaust pipe without any problems. Alternatively, both the oxygen sensor and the temperature sensor may be provided to the downstream side of both the left and right exhaust pipes. That is, the oxygen sensor and the temperature sensor may be set as desired.

Referring also to FIG. 1 and FIG. 8, the upper end 52*a* of the oxygen sensor 52 is directed inward in the vehicle width direction, and overlaps with the left and right protectors 35L, 35R which cover the pair of left and right exhaust pipes 41L, 41R. That is, the oxygen sensor 52 is arranged at the position where the oxygen sensor 52 is not exposed to the outside in the vehicle width direction and hence, it is possible to provide the structure which is minimally cooled by an external environment such as rain or a traveling wind. As a result, a state of the catalysts 48L, 48R can be determined more accurately.

Returning to FIG. 4, the connecting pipe 54 is arranged such that the connecting pipe 54 is below the oxygen sensor 52 and overlaps with the oxygen sensor 52 in a longitudinal direction of the vehicle. A traveling wind which flows below the vehicle, muddy water splashed by the front wheel 15 (see FIG. 1) or the like hits the connecting pipe 54 arranged below the oxygen sensor 52 and hence, a traveling wind, muddy water or the like minimally hits the oxygen sensor 52. Accordingly, the oxygen sensor 52 has the structure where the oxygen sensor 52 is minimally cooled by an external environment such as a traveling wind or muddy water. Eventually, the oxygen sensor 52 can determine a state of the catalysts 48L, 48R more accurately.

Although the embodiments are applied to the motorcycle in the above description, the application is also applicable to a three-wheeled vehicle and may be applied to vehicles in general without any problems.

The embodiments are preferably applicable to a motorcycle where an oxygen sensor is provided to a downstream side of a catalyst in an exhaust device of an engine.

DESCRIPTION OF REFERENCE NUMERALS AND SIGNS

10: motorcycle
14: engine
34L, 34R: protector
40: exhaust device
41L, 41R: exhaust pipe
43L, 43R: merging portion
44L, 44R: muffler
48L, 48R: catalyst
52: (downstream side) oxygen sensor
53: temperature sensor
54: connecting pipe
55L, 55R: branching portion

What is claimed is:

1. An exhaust device of a motorcycle, comprising:

a left and right exhaust pipes configured to discharge an exhaust gas from a multi-cylinder engine, the left and right exhaust pipes including:

a muffler connected to a downstream side of the left and right exhaust pipes, the muffler configured to reduce an exhaust noise and to discharge the exhaust gas to an outside of the motorcycle, a merging portion configured to merge the exhaust gas discharged from respective cylinders of the multi-cylinder engine, a catalyst configured to purify the exhaust gas discharged through the merging portion, respectively, and a branching portion, on a downstream side of the catalyst, which has a first side thereof extending to the muffler and a second side thereof extending to a connecting pipe configured to interconnect the left and right exhaust pipes to each other; and an oxygen sensor present in the first side on a downstream side of a left and right branching portions of the branching portion, whereby the exhaust gas is stirred in a rear portion of the merging portion and the branching portion, and wherein the connecting pipe is arranged below the oxygen sensor and overlaps the oxygen sensor in a longitudinal direction of the motorcycle.

2. The exhaust device of the motorcycle according to claim 1, wherein an upper end of the oxygen sensor is directed toward the inside of the motorcycle in a motorcycle width direction, and overlaps with left and right protectors that cover the left and right exhaust pipes as viewed in a side view of the motorcycle.

3. The exhaust device of the motorcycle according to claim 1, wherein an upper end of the oxygen sensor is directed toward an inside of the motorcycle in a motorcycle width direction, and overlaps with left and right protectors that cover the left and right exhaust pipes as viewed in a side view of the motorcycle.

4. The exhaust device of the motorcycle according to claim 1, wherein an upper end of the oxygen sensor is directed toward an inside of the motorcycle in a motorcycle width direction, and overlaps with left and right protectors that cover the pair of left and right exhaust pipes as viewed in a side view of the motorcycle.

* * * * *